US009048048B2

(12) United States Patent
Takeda

(10) Patent No.: US 9,048,048 B2
(45) Date of Patent: Jun. 2, 2015

(54) THERMAL PROTECTOR

(75) Inventor: Hideaki Takeda, Misato (JP)

(73) Assignee: Uchiya Thermostat Co., Ltd., Saitama-Ken (JP)

( * ) Notice: Subject to any disclaimer, the term of this patent is extended or adjusted under 35 U.S.C. 154(b) by 91 days.

(21) Appl. No.: 13/587,021

(22) Filed: Aug. 16, 2012

(65) Prior Publication Data

US 2014/0049355 A1 Feb. 20, 2014

(51) Int. Cl.
*H01H 37/54* (2006.01)
*H01H 1/26* (2006.01)

(52) U.S. Cl.
CPC ..... *H01H 37/54* (2013.01); *H01H 1/26* (2013.01); *H01H 2037/549* (2013.01)

(58) Field of Classification Search
CPC ..... H01H 37/57; H01H 37/60; H01H 37/68; H01H 37/52; H01H 37/12; H01H 2037/5463; H01H 81/02; H01H 37/54; H01H 2037/549; G01K 5/62
USPC ..... 337/365, 333, 362, 372
See application file for complete search history.

(56) References Cited

U.S. PATENT DOCUMENTS

| | | | | |
|---|---|---|---|---|
| 3,737,825 | A * | 6/1973 | Summe et al. | 337/91 |
| 3,821,679 | A * | 6/1974 | Summe | 337/101 |
| 4,008,453 | A * | 2/1977 | Hacker et al. | 337/345 |
| 4,423,402 | A * | 12/1983 | Jackson et al. | 337/323 |
| 5,107,241 | A * | 4/1992 | Ubukata et al. | 337/368 |
| 5,363,552 | A * | 11/1994 | Coniff | 29/840 |
| 5,367,279 | A * | 11/1994 | Sakai | 337/104 |
| 5,867,085 | A * | 2/1999 | Kruck et al. | 337/380 |
| 5,896,080 | A * | 4/1999 | Chen | 337/407 |
| 6,005,471 | A * | 12/1999 | Higashikata et al. | 337/347 |
| 6,841,745 | B2 * | 1/2005 | Takigawa | 200/61.06 |
| 2002/0003465 | A1 * | 1/2002 | Takeda | 337/298 |
| 2005/0122205 | A1 * | 6/2005 | Stiekel et al. | 337/377 |
| 2005/0264393 | A1 * | 12/2005 | Yamada | 337/85 |

(Continued)

FOREIGN PATENT DOCUMENTS

| | | |
|---|---|---|
| JP | 48-19157 | 3/1973 |
| JP | 2-46344 | 3/1990 |

(Continued)

OTHER PUBLICATIONS

Japanese Patent Office, Office Action for Japanese Application No. 2010-049443, 4 pages Oct. 11, 2013.

*Primary Examiner* — Anatoly Vortman
(74) *Attorney, Agent, or Firm* — Trop, Pruner & Hu, P.C.

(57) ABSTRACT

A thermal protector for opening and closing an electric circuit, includes: a movable plate having a movable contact point mounted on a one end portion thereof and having a terminal mounted on an opposite end portion thereof; a bypass member joined to the movable plate at the end portions of the movable plate on which the movable contact point and the terminal are mounted; and a thermal responsive element for moving the movable contact point of the movable plate by a snap action thereof to open and close the electric circuit, wherein the bypass member is formed of a first metal material having a higher conductivity than a second metal material of which the movable plate is formed, and the movable plate and the bypass member are joined together and are subjected to heat treatment so that the first metal material of the bypass member is softened while the second metal material of the movable plate is precipitation-hardened.

6 Claims, 2 Drawing Sheets

(56) References Cited

U.S. PATENT DOCUMENTS

| | | | | |
|---|---|---|---|---|
| 2008/0025373 | A1* | 1/2008 | Toyoda et al. | 374/188 |
| 2008/0061922 | A1* | 3/2008 | Nakamura et al. | 337/298 |
| 2010/0026446 | A1* | 2/2010 | Takeda | 337/372 |
| 2012/0001721 | A1* | 1/2012 | Takeda | 337/372 |
| 2012/0032773 | A1* | 2/2012 | Takeda | 337/362 |

FOREIGN PATENT DOCUMENTS

| | | |
|---|---|---|
| JP | 05-081983 | 4/1993 |
| JP | 06-119859 | 4/1994 |
| JP | 2004-133568 | 4/2004 |
| JP | 2005-267932 | 9/2005 |

* cited by examiner

THERMAL PROTECTOR

CROSS-REFERENCE TO RELATED APPLICATION

The disclosure of Japanese Patent Application No. 2010-049443 filed on Mar. 5, 2010, including the specification, claims, drawings, and summary are incorporated herein by reference in its entirety.

BACKGROUND OF THE INVENTION

The present invention relates to a thermal protector, more particularly to a thermal protector suitable for a temperature switch which is activated at a high operating temperature such as over 200° C. and has a relatively large current rating.

There has been known a thermal protector which uses a bimetal element as a thermal responsive element to open and close an electric circuit thereof using an inverting action of the element which occurs at a predetermined temperature. As an example of such a thermal protector, Japanese Patent Publication No. 2844026 discloses a thermal protector including a movable plate which has a movable contact point at a distal end thereof and constituted of a spring material; and a sheet-like thermal responsive element which performs an inverting action and is fixed to a terminal portion of the movable plate. Then, the movable contact point of the movable plate is pressed to a fixed contact point by the distal end of the thermal responsive element.

Concerning a structure of a relay, Japanese Patent Application Publication No. 05-81983 discloses a system for connecting a contact point with a movable plate mounting portion through a flexible conductive wire in order to prevent the movable plate from being fused when a short-circuit current flows. Furthermore, Japanese Patent Application Publication No. 2004-133568 discloses a configuration of a power switch including a resistor and a contact point both connected in series with a bimetal, in which both ends of the bimetal and the resistor are short-circuited with another switch. As a result, when the bimetal was heated by a current and then inverted, the first switch is closed.

SUMMARY OF THE INVENTION

A material used for a high-temperature thermal protector must be chosen according to a restriction based on a heat resistant temperature of the material itself and a temperature upper limit based on a related Safety Standard. Although as a material of the movable plate of the thermal protector, conventionally, copper alloy, which is representative of low-resistance materials, is usually used, the copper alloy undergoes an excessive deterioration in spring performance if it is placed under high temperatures. More specifically, a usage environment of the copper alloy is restricted to temperatures up to 230° C. and beryllium copper used for the springs cannot be used in such a high temperature range.

Thus, in the range in which use of the copper alloy is restricted, steel (iron and its alloys) whose restriction temperature is 400° C. is generally used. Of the steels, as a spring material, particularly stainless steel is often used and there are a variety of stainless steel alloys. However, the stainless steels have a large specific resistance in common and when each of them is used for the movable plate of the thermal protector through which a large current flows, a large amount of Joule heat is generated when the current flows, so that an operating temperature of the thermal protector drops remarkably.

Accordingly, in view of the above-described problems, an object of the present invention is to provide a thermal protector configured to be capable of preventing deterioration of the spring performance of the movable plate under high temperatures, maintaining a contact pressure at a contact point even under high temperatures, and keeping an internal resistance low to prevent the operating temperature from dropping.

To achieve the above-described object, the present invention provides a thermal protector for opening and closing an electric circuit, including: a movable plate having a movable contact point mounted on one end portion thereof and having a terminal mounted on an opposite end portion thereof; a bypass member joined to the movable plate at the end portions of the movable plate on which the movable contact point and the terminal are mounted; and a thermal responsive element for moving the movable contact point of the movable plate by a snap action thereof to open and close the electric circuit, in which the bypass member is formed of a first metal material having a higher conductivity than a second metal material of which the movable plate is formed, and the movable plate and the bypass member are joined together and are subjected to heat treatment so that the first metal material of the bypass member is softened while the second metal material of the movable plate is precipitation-hardened.

The second metal material of the movable plate may be stainless steel and the first metal material of the bypass member may be aluminum. The movable plate and the bypass member may have a substantially identical shape in top plan view between the end portions on which the movable contact point and the terminal are mounted. Preferably, the movable plate and the bypass member are not in contact with each other except at the end portions on which the movable contact point and the terminal are mounted. The thickness of the bypass member may be at most four times the thickness of the movable plate. The snap action of the thermal responsive element may be of single-operation type.

According to the present invention, the movable plate and the bypass member are joined together at the specified end portions thereof and the assembly part of the movable plate and the bypass member is subjected to heat treatment to induce precipitation-hardening of the metal material of the movable plate. Consequently, hardness of the metal material of the movable plate is increased, thereby preventing deterioration of spring performance even when the thermal protector is heated to high temperatures. As a result, the contact pressure of the contact point can be maintained. Because the bypass member having a high conductivity is joined to the movable plate, the internal resistance of the thermal protector is decreased to suppress generation of Joule heat due to conducted current, thereby preventing the operating temperature of the thermal protector from dropping. By joining together the movable plate and the bypass member prior to the heat treatment for the precipitation hardening of the metal material of the movable plate, resistance welding can be executed easily because the metal material of the movable plate has no strong film and the metal material of the bypass member has excellent morphological stability.

DESCRIPTION OF PREFERRED EMBODIMENTS

Figure 1:
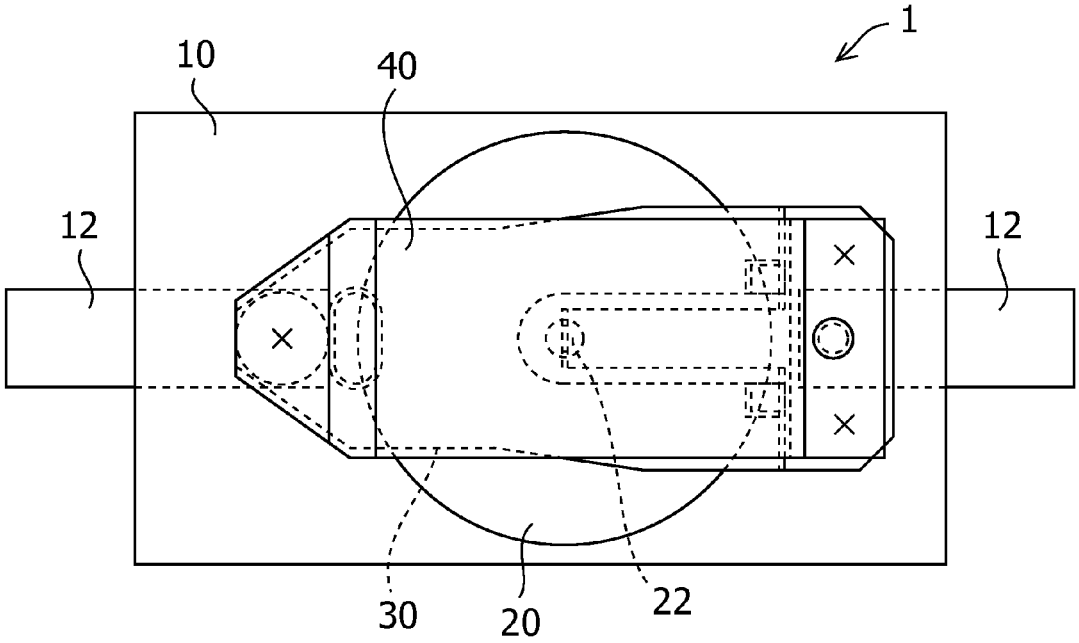
FIG. 1 is a plan view showing a thermal protector according to an embodiment of the present invention.

Hereinafter, an embodiment of the thermal protector according to the present invention will be described with reference to the accompanying drawings. As shown in FIGS. 1 to 4, the thermal protector 1 of this embodiment includes mainly a base 10, a bimetal element 20 which acts as a thermal responsive element, a movable plate 30, and a bypass member 40.

The base 10 is made of an insulating sheet-like member. The bimetal element 20, the movable plate 30 and the bypass member 40 are mounted on the surface of the base 10, while a lead wire 12 is mounted on a back surface thereof. To connect the movable plate 30 and the bypass member 40 with the lead wire 12 electrically, the base 10 has a through hole 11 which passes through from a front surface to the back surface.

The bimetal element 20 includes two metal plates, each having a different coefficient of thermal expansion, which are bonded together. This is a snap-acting type thermal responsive element whose curved direction is inverted instantaneously when the temperature rises up to a predetermined inversion temperature. Preferably, the inversion temperature of the bimetal element is 150° C. or more, and more preferably 200° C. or more. Preferably, the upper limit of the inversion temperature is 350° C. or less and more preferably, 300° C. or less. The bimetal element 20 has a circular outer shape and a central hole 22 is provided in a center thereof.

The larger a difference between an operating temperature and a restoration temperature, the larger an output of the bimetal element 20 is. By setting the restoration temperature to a temperature which does not allow the bimetal to be restored under an ordinary environment, it is preferable to construct the bimetal element 20 into a single-operation device (SOD) type thermal protector 1 in which the operation thereof occurs once. In this case, preferably, the restoration temperature is, for example, −35° C. or less. The SOD allows an influence of metallic fatigue of a joint portion between the movable plate 30 and the bypass member 40 each made of a different metal material to be ignored.

The movable plate 30 has a movable contact point 32 on a surface on the side of a base 10 at a distal end thereof. The movable plate 30 has a terminal portion 31 to be fixed to the base 10 at an end portion on the opposite side (hereinafter referred to as terminal side also). The terminal portion 31 has a through hole 33 for connecting to the lead wire 12 on a terminal side electrically.

The movable plate 30 has a supporting shaft 34 extending vertically from the base 10 at a central portion thereof. To prevent a distal end of the supporting shaft 34 from disturbing the motion of the movable plate 30 due to a contact with a main body portion 30*a* of the movable plate 30, a clearance hole 35 is provided in the central portion of the movable plate main body portion 30*a*. Further, the movable plate main body portion 30*a* has projecting portions 36, 37 projecting toward the base 10 such that they are adjacent to each of the terminal portion 31 and the movable contact point 32.

The bypass member 40 has a terminal portion 41 to be fixed to the base 10 and the movable plate 30 at an end portion of a side thereof. This terminal portion 41 has a through hole 43 for connecting to the lead wire 12 on the terminal side electrically. Additionally, the bypass member 40 has a movable portion 42 at an end portion on the opposite side with the movable contact point 32 of the movable plate 30 mounted on an opposing surface. The bypass member 40 has a main body portion 40*a* which is projected in an opposite direction to the movable plate 30 between the terminal portion 41 and the movable portion 42 in order to prevent the bypass member 40 from making contact with the movable plate 30.

Figure 2A:
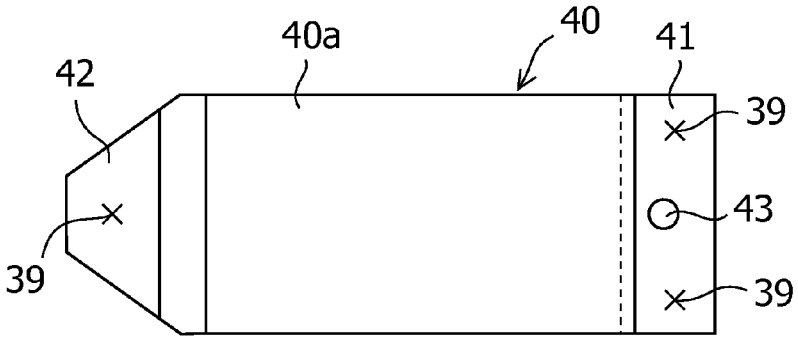
FIG. 2A is a plan view showing a bypass member of the thermal protector of FIG. 1.
Figure 2B:
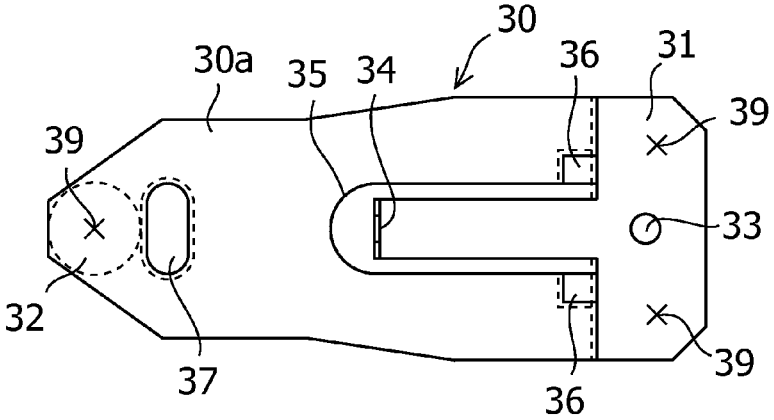
FIG. 2B is a plan view showing a movable plate of the thermal protector of FIG. 1.
Figure 3:
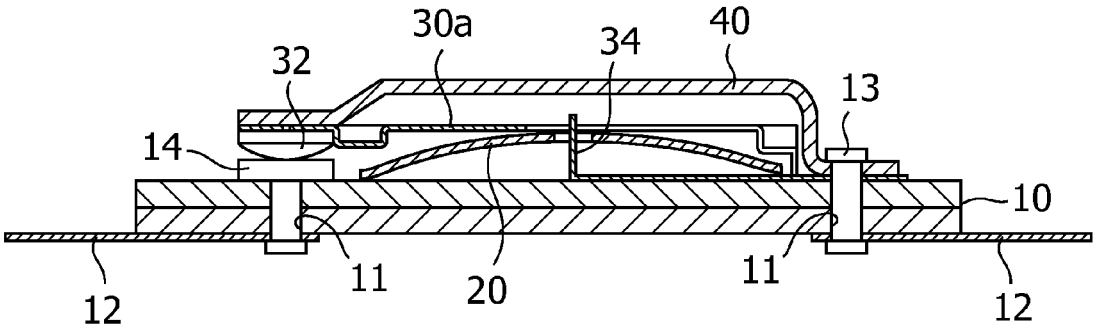
FIG. 3 is a side sectional view of the thermal protector shown in FIG. 1 indicating a state in which a movable contact point is in contact with a fixed contact point.

Although, as shown in FIGS. 1 and 2, the main body portion 40*a* of the bypass member has an identical flat plane to the main body portion 30*a* of the movable plate 30, the embodiment of the present invention is not restricted to this example. For example, the width of the main body portion 40*a* of the bypass member may be larger or smaller than the width of the movable plate main body portion 30*a*.

The movable plate 30 is formed of a precipitation hardening type metal material. The precipitation hardening mentioned here refers to hardening of metal material due to precipitation of fine crystal structure inside of the metal material by heat treatment. As the precipitation hardening type metal material, precipitation hardening type stainless steel is preferable. As the precipitation hardening type stainless steel, specifically, for example, SUS631 or SUS632 is preferable. Of those materials, particularly, SUS631 subjected to CH treatment for inducing precipitation hardening by heat treatment at 475° C.±10° C. is preferable (JIS G 4313). In the meantime, when a spring material made of work-hardening type stainless alloy is subjected to heat treatment at 300° C. to 370° C., the spring performance is deteriorated.

The thickness of the movable plate 30 is not restricted to any particular value as long as the spring performance of the movable plate 30 can be so maintained that the movable contact point 32 mounted at the distal end can contact or leave the fixed contact point 14. For example, if stainless steel is used as a material, preferably, the thickness of the movable plate 30 is 0.1 mm to 0.2 mm, more preferably 0.15 mm, although it is related to the width of the movable plate and an output of the bimetal element.

Although the material for the bypass member 40 is not restricted to any particular one as long as it is a metal material more flexible and having a higher conductivity than the movable plate 30, it is preferred to be formed of aluminum or the like. As an aluminum, high-purity aluminum is preferred. The high-purity aluminum mentioned in this specification refers to aluminum or aluminum alloy whose content of aluminum is 99% or more. More specifically, it is preferred to use aluminum alloys each having an alloy number 1080, 1070, 1050, 1100, 1200 or 1N00 specified under JIS H 4000.

The thickness of the bypass member 40 is not limited to any particular one as long as the bypass member 40 can maintain a flexibility not blocking the motion of the movable plate 30. For example, when aluminum is used as a material, the thickness of the bypass member 40 is preferred to be 0.15 mm to 0.5 mm and more preferred to be 0.3 mm to 0.5 mm, although it is related to a width of the plate and an output of the bimetal. Thus, as a criterion, the thickness of the bypass member 40 is preferred to be four times or less the thickness of the movable plate 30. In the meantime, the bypass member 40 may be formed by placing a plurality of thinner sheet materials than the movable plate 30 one on another. For example, it is permissible to stack three pieces of aluminum plates 0.1 mm in thickness and weld both ends of those sheets to produce the bypass member 40.

An assembly method of the thermal protector 1 will be described below. First, the movable plate 30 and the bypass member 40 are joined together. Because this joint requires connection stability under high temperatures, welding is preferable. Because for the movable plate 30, a metal material prior to heat treatment for precipitation hardening without any strong film is used, resistance welding can be executed. For the bypass member 40 also, a metal material prior to heat treatment for precipitation hardening is used and therefore, a difference in hardness with respect to the movable plate 30 is so small that the resistance welding can be made. As for the welding, as shown in FIG. 2, the bypass member 40 is placed over the surface of the movable plate 30 and welded at three joining positions 39. That is, on the terminal side, the terminal portion 31 of the movable plate 30 and the terminal portion 41 of the bypass member 40 are welded together at two of the joining positions 39. On a distal end side, the back surface of the movable contact point 32 of the movable plate 30 and the movable portion 32 of the bypass member 40 are welded at one of the joining position 39. In the meantime, the through hole 33 in the movable plate 30 is matched with the through hole 43 in the bypass member 40.

After welding, heat treatment for precipitation hardening is carried out on the metal material of the movable plate 30. Upon CH treatment of stainless steel of SUS361 as such a kind of the heat treatment, this heat treatment is carried out for an hour at 475° C.±10° C. according to JIS G 4313. When the precipitation hardening of the metal material of the movable plate 30 is completed, its hardness is increased so that the metal material is processed to a spring material having a large elasticity. On the other hand, in case in which the metal material of the bypass member 40 is, for example, aluminum, it is work-hardened by rolling. However, if the aluminum undergoes a heat treatment at high temperatures of 300° C. or higher, particularly 370° C. or higher in the hardened state induced by distortion generated inside by the rolling, recrystallization is progressed so that the distortion inside vanishes and the aluminum turns into an annealed state and becomes softened to yield flexibility. Such a softened bypass member has a poor morphological stability thereby making it difficult to perform resistance welding. Particularly when a high-purity aluminum is used, the aluminum turns into a full annealed state so that the hardness is decreased up to about 1/10 the initial period. In the meantime, the high-purity aluminum does not need to be age-hardened after the annealing process.

After both the members are welded together in the above-described assembly process, heat treatment is carried out under the precipitation hardening conditions. As a result, a contact pressure of a contact point necessary functionally as a switch of the thermal protector 1 can be obtained with the movable plate 30 made of precipitation-hardened stainless steel and at the same time, an internal resistance can be greatly reduced by the bypass member 40 which connects the movable contact point 32 to the terminal portion 31 by bypassing the movable plate main body portion 30*a*. Further, the metal material of the bypass member 40 is softened because of its annealed state, thereby stopping the bypass member 40 from blocking the motion of the movable plate 30 and the inversion action of the bimetal element 20.

Next, the heat-treated assembly part of the movable plate 30 and the bypass member 40 is attached to the base 10 together with the bimetal element 20 and the lead wire 12. More specifically, the bimetal element 20 is mounted such that the curve of the bimetal element 20 is projected with respect to the movable plate main body portion 30*a* and the supporting shaft 34 of the movable plate 30 is fit to the central hole 22 in the bimetal element 20 such that the supporting shaft 34 can move through freely. By inserting a terminal pin 13 into the through hole 43 in the bypass member 40, the through hole 33 in the movable plate 30, the through hole 11 in the terminal side of the base 10 and a through hole (not shown) in the lead wire 12 on the terminal side, the lead wire 12 on the terminal side is attached. Further, by inserting a fixed contact point pin 14 into the through hole 11 on the movable contact point side of the base and a through hole (not shown) in the lead wire 12 on the movable contact point side, the lead wire 12 on the movable contact point side is attached.

In the thermal protector assembled as described above, as shown in FIG. 3, the movable contact point 32 provided on the distal end of the movable plate 30 makes contact with a head portion of the fixed contact point pin 14. Because the spring elasticity of the movable plate 30 has been intensified by the heat treatment for the precipitation hardening, a contact pressure between the movable contact point of the distal end of the movable plate 30 and the fixed contact point 14 of the base 10 can be increased and at the same time, the contact pressure can be prevented from dropping even if the thermal protector 1 is used under high temperatures.

An internal resistance of the thermal protector 1 is reduced largely by the bypass member 40. For example, in case in which the bypass member 40 is of aluminum, the resistivity thereof is $2.5\times10^{-8}$ Ωm and in case in which the movable plate 30 is of stainless steel, the resistivity thereof is $100\times10^{-8}$ Ωm. That is, the bypass member 40 has a difference in resistance of 1/40 with respect to the movable plate 30. Thus, most current flows through the bypass member 40 having a smaller specific resistance. That is, the internal resistance of the thermal protector 1 when the movable contact point 1 is closed is reduced and therefore, the entire resistance can be reduced to about several tens of percent or less although the value depends on the sectional area and the length of the bypass member 40 made of aluminum and conditions of the movable contact point and the terminal portion. Therefore, the thermal protector 1 can conduct a larger current than conventional ones.

Figure 4:
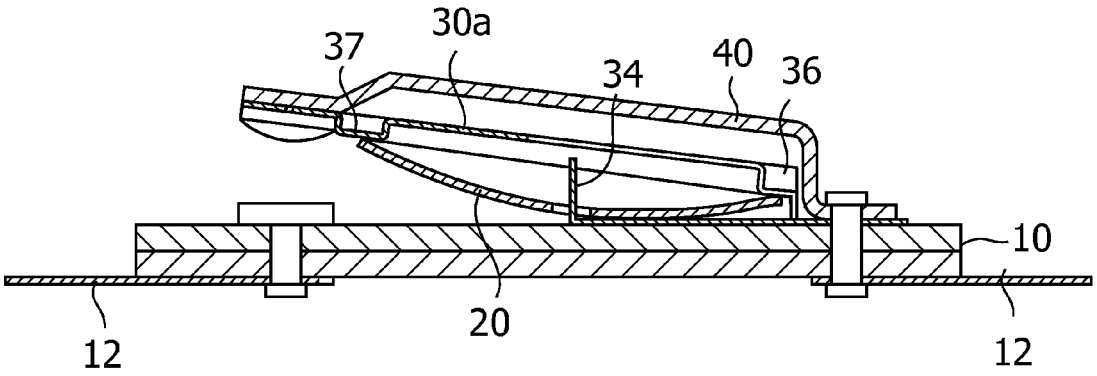
FIG. 4 is a side sectional view of the thermal protector shown in FIG. 1, indicating a state in which the movable contact point is apart from the fixed contact point.

In this thermal protector 1, as shown in FIG. 4, when the bimetal element 20 reaches a predetermined inversion temperature, the bimetal element 20 is inverted and curved so that it is projected against the base 10. At this time, a central portion of the bimetal element 20 maintains contact with the base 10 and outside edges of the bimetal element 20 keep contact with the projecting portions 36, 37 of the movable plate 30. Consequently, the movable plate 30 is pushed up by the bimetal element 20, so that the movable contact point 32 is moved to leave the fixed contact point pin 14. The movement of the movable plate 30 is performed by the elasticity of the movable plate 30. Because the bypass member 40 has been softened by annealing as described above, the bypass member 40 never obstructs the movement of the movable plate 30 and the inverting action of the bimetal element 20.

Many other variations and modifications of the invention will be apparent to those skilled in the art without departing from the spirit and scope of the invention. The above-described embodiments are, therefore, intended to be merely exemplary, and all such variations and modifications are intended to be included within the scope of the invention as defined in the appended claims.

What is claimed is:

1. A thermal protector for opening and closing an electric circuit, comprising:

a movable plate acting as a spring and having a first end portion, a second end portion opposite to the first end portion, and a main body portion extending between the first and second end portions;

a bypass member having a first end portion, a second end portion opposite to the first end portion, the first and second end portions of the bypass member being joined to the first and second end portions of the movable plate, respectively, the bypass member allows current to flow so as to bypass the main body portion of the movable plate;

a movable contact point mounted on the joined first end portions of the movable plate and of the bypass member, the joined first end portions forming a free end of a cantilever structure formed by the movable plate and the bypass member such that the movable contact point moves to open the electric circuit;

a terminal mounted on the joined second end portions of the movable plate and the bypass member, the joined second end portions forming a fixed end of the cantilever structure, the fixed end being opposite the free end; and a thermal responsive element for moving the movable contact point by a snap action thereof such that the electric circuit is opened by the snap action, the snap action occurring due to heat generated by the movable plate, wherein the bypass member is formed of a first metal material having a higher conductivity than a second metal material of which the movable plate is formed, and the movable plate and the bypass member are joined together and are subjected to heat treatment so that the first metal material of the bypass member is softened while the second metal material of the movable plate is precipitation-hardened to increase the spring performance of the movable plate.

2. The thermal protector according to claim 1, wherein the second metal material of the movable plate is stainless steel and the first metal material of the bypass member is aluminum.

3. The thermal protector according to claim 1, wherein the movable plate and the bypass member have a substantially identical shape in top plan view between the end portions on which the movable contact point and the terminal are mounted.

4. The thermal protector according to claim 1, wherein the movable plate and the bypass member are not in contact with each other except at the end portions on which the movable contact point and the terminal are mounted.

5. The thermal protector according to claim 1, wherein a thickness of the bypass member is at most four times a thickness of the movable plate.

6. The thermal protector according to claim 1, wherein the snap action of the thermal responsive element is of single-operation type.

* * * * *